US007024741B2

(12) United States Patent
Shibata

(10) Patent No.: US 7,024,741 B2
(45) Date of Patent: Apr. 11, 2006

(54) FASTENING STRUCTURE WITH A RIVET

(75) Inventor: Hiroshi Shibata, Toyohashi (JP)

(73) Assignee: Newfrey LLC, Newark, DE (US)

( * ) Notice: Subject to any disclaimer, the term of this patent is extended or adjusted under 35 U.S.C. 154(b) by 138 days.

(21) Appl. No.: 10/731,793

(22) Filed: Dec. 9, 2003

(65) Prior Publication Data

US 2004/0165945 A1 Aug. 26, 2004

Related U.S. Application Data

(63) Continuation of application No. PCT/US02/20405, filed on Jun. 26, 2002.

(30) Foreign Application Priority Data

Jun. 27, 2001 (JP) ..... 2001-194044

(51) Int. Cl.
*B21J 15/34* (2006.01)

(52) U.S. Cl. ..... 29/243.529; 29/243.522; 72/391.4

(58) Field of Classification Search ..... 29/243.529, 29/243.52, 243.522; 72/391.4, 391.6
See application file for complete search history.

(56) References Cited

U.S. PATENT DOCUMENTS

| | | | |
|---|---|---|---|
| 2,405,897 | A | 8/1946 | Milone et al. |
| 3,122,948 | A | 3/1964 | Baugh et al. |
| 3,276,308 | A | 10/1966 | Bergere |
| 3,788,123 | A | 1/1974 | Gulistan |
| 3,977,229 | A | 8/1976 | Alvi et al. |
| 6,042,313 | A | 3/2000 | Dehlke |

FOREIGN PATENT DOCUMENTS

| | | |
|---|---|---|
| FR | 1 272 956 | 10/1961 |

*Primary Examiner*—David Jones
(74) *Attorney, Agent, or Firm*—Harness, Dickey & Pierce, P.L.C.

(57) ABSTRACT

A fastening tool draws a mandrel (5) to allow a caulking portion of the mandrel to deform a stem of a rivet (2) so that workpieces are fastened together. The fastening tool used in this process includes a nosepiece having a protrusion. During caulking, the protrusion of the nosepiece applies a force on a flange of the rivet to form a recess in the rivet flange and thereby peel a coating of the workpieces. As a result, electrical conductivity between the workpieces and the rivet is obtained.

4 Claims, 6 Drawing Sheets

FASTENING STRUCTURE WITH A RIVET

CROSS-REFERENCE TO RELATED APPLICATIONS

This application is a Continuation of International Application No. PCT/US02/20405, filed Jun. 26, 2002 and designating the United States. This application claims the benefit of Japanese Application No. 2001-194044, filed Jun. 27, 2001. The disclosure(s) of the above application(s) is (are) incorporated herein by reference.

FIELD OF INVENTION

The present invention relates to a technique of assuring electrical conductivity in workpieces when coated workpieces such as electrical instruments, automobile bodies, are fastened with a rivet.

BACKGROUND OF THE INVENTION

Heretofore, a rivet has been widely used to fasten two workpieces such as two steel sheets. In this case, a mandrel having a caulking portion and a shank is disposed in a hollow rivet having a flange and a stem, and this combination of the mandrel and rivet is inserted into a hole formed in the workpieces. Then, a nosepiece fixed to a fastening tool is brought into contact with the flange of the rivet, and the shank of the mandrel is drawn by the fastening tool to deform the stem of the rivet to increase in its diameter. The mandrel is broken at a breaking portion thereof during the drawing of the mandrel shank. Thus, the workpieces are fastened between the flange and the deformed portion of the rivet.

The fastening tool for fastening the rivet to the workpieces is known in the art. The fastening tool comprises an elongated hollow housing, a jaw provided inside the housing movably rearward and adapted to engage with the side surface of the mandrel and hold the mandrel, and a nosepiece adapted to be attached at the front end of the housing and to engage with the flange of the rivet. When the jaw is moved rearward to draw out the front end of the mandrel held by the jaw, the mandrel is broken at a breaking portion thereof, and the rivet is deformed to increase in its diameter by the rear end of the mandrel so as to fasten the workpieces together.

When the workpieces covered by a typical coating are fastened with the rivet in the conventional manner, the coating of one of the workpieces on the side of the stem of the rivet is partially peeled by a force caused when the rivet is deformed to increase in its diameter, and thereby the stem-side workpiece and the rivet can assure electrical conductivity therebetween. On the other hand, no strong pressure is applied on the flange-side workpiece, and thereby the coating of the flange-side workpiece is not peeled. Thus, it has been difficult to assure electrical conductivity between the flange-side workpiece and the rivet.

The present invention has been made to solve the above problem. Therefore, the present invention is directed to assure electrical conductivity between the flange-side workpiece and the rivet as well as between the stem-side workpiece and the rivet.

SUMMARY OF THE INVENTION

In the present invention, when a stem of a rivet is deformed to increase in its diameter by a mandrel so as to fasten workpieces together, a nosepiece having a protrusion is used. During caulking, the protrusion of the nosepiece is brought pressingly into contact with a flange of the rivet to form a recess in the flange of the rivet and thereby partially peel a coating of one of the workpiece on the side of the flange. As a result, electrical conductivity between the flange-side workpiece and the rivet is assured.

According to the present invention, there is provided a nosepiece comprising a protrusion for forming a recess in a flange of a rivet.

Further, the present invention is directed to a fastened structure comprising a rivet, a mandrel, and workpieces fastened together with the rivet and the mandrel. In this fastened structure, the rivet includes a flange having a recess formed by a nosepiece attached to a fastening tool and provided with a protrusion, and a stem deformed to increase in its diameter by a caulking portion of the mandrel. The recess is formed in the flange and the stem is deformed when a shank of the mandrel is drawn by the fastening tool. Further, a coating on one of the workpieces on the side of the flange was partially peeled due to the formed recess, whereby the flange-side workpiece and the rivet are electrically conducted to one another.

Further, the present invention is directed to a method for fastening workpieces together with a rivet. This method comprises the steps of: combining a mandrel having a caulking portion and a shank with a hollow rivet having a flange and a stem, and positioning the combined mandrel and rivet in a hole formed in the workpieces; bringing a nosepiece fixed to a fastening tool and provided with a protrusion into contact with the flange of the rivet; drawing the shank of the mandrel by the fastening tool to deform the stem of the rivet to increase in its diameter; breaking the mandrel at a breaking portion thereof during the drawing of the mandrel shank; and making the protrusion of the nosepiece fixed to the fastening tool bite into the flange of the rivet to form a recess in the flange of the rivet and thereby partially peel a coating of one of the workpieces on the side of the flange. As a result, electrical conductivity between the flange-side workpiece and the rivet is established.

Further, the present invention is directed to a fastening tool for fastening workpieces with a rivet and a mandrel. This fastening tool comprises: an elongated hollow housing; a jaw provided inside said housing movably rearward and adapted to engage with and hold a shank of the mandrel; and a nosepiece adapted to be attached at the front end of the housing and to engage with a flange of the rivet. The nosepiece has a protrusion. When the jaw is moved rearward to draw out the shank of the mandrel held by the jaw, the mandrel is operable to deform the rivet to increase in its diameter by a caulking portion of the mandrel and to be broken at a breaking portion of the mandrel. The protrusion of the nosepiece is adapted to bite into the flange of the rivet to form a recess in the flange and thereby partially peel a coating of the workpieces, whereby electrical conductivity between the workpieces and said rivet is established.

DETAILED DESCRIPTION OF THE PREFERRED EMBODIMENT

With reference to the drawings, an embodiment of the present invention will now be described.

Figure 1:
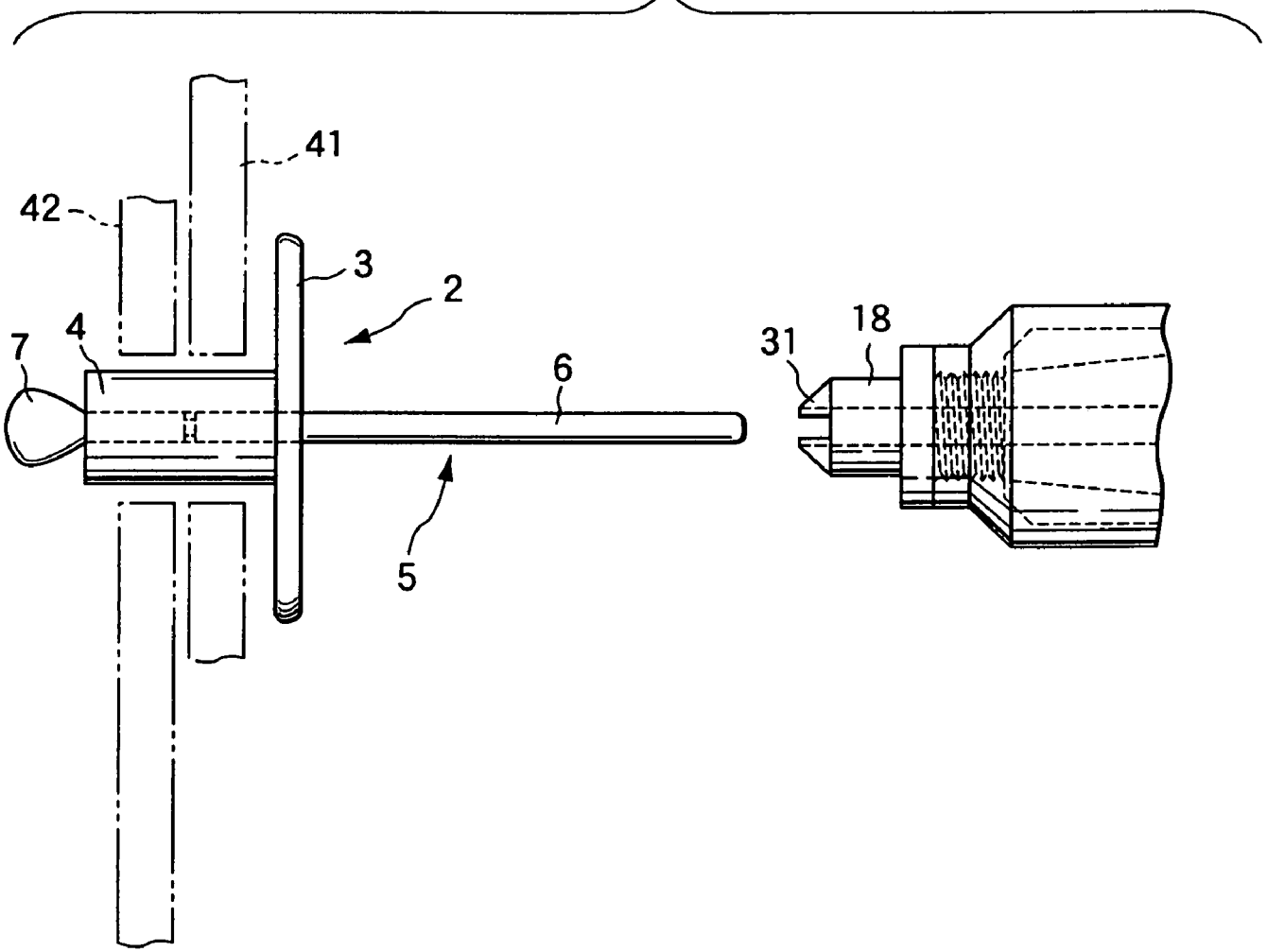
FIG. 1 is a schematic diagram showing workpieces are fastened with a rivet.

FIG. 1 is a schematic diagram showing workpieces are being fastened with a rivet according to the present invention. Two workpieces 41 and 42 to be fastened together are shown by dotted lines. A rivet 2 includes a flange 3 and a stem 4. A mandrel 5 has a shank 6 and a caulking portion 7. The shank 6 of the mandrel 5 is inserted into a hollow portion of the rivet 2, and they are inserted into a hole formed in the workpieces 41 and 42. The shank 6 of the mandrel 5 is inserted into a fastening tool. A nosepiece 18 is attached to the front end of the fastening tool, and a protrusion 31 is provided on the front end of the nosepiece 18. The protrusion 31 of the nosepiece 18 is brought into contact with the flange 3 of the rivet 2, and the shank 6 of the mandrel 5 is drawn by the fastening tool. Thus, the stem 4 of the rivet is deformed to increase its diameter by the caulking portion 7 of the mandrel so as to fasten the workpieces 41 and 42 together. During the drawing of the mandrel, the mandrel 5 is broken at a breaking portion formed in the mandrel. Further, during the drawing of the mandrel, the protrusion 31 of the nosepiece 18 bites into the flange 3 of the rivet 2 to form a recess in the flange 3 of the rivet 2. At this time, a coating of one of the workpieces on the side of the flange is peeled. Thus, the flange-side workpiece and the rivet are electrically conducted to one another.

Figure 2:
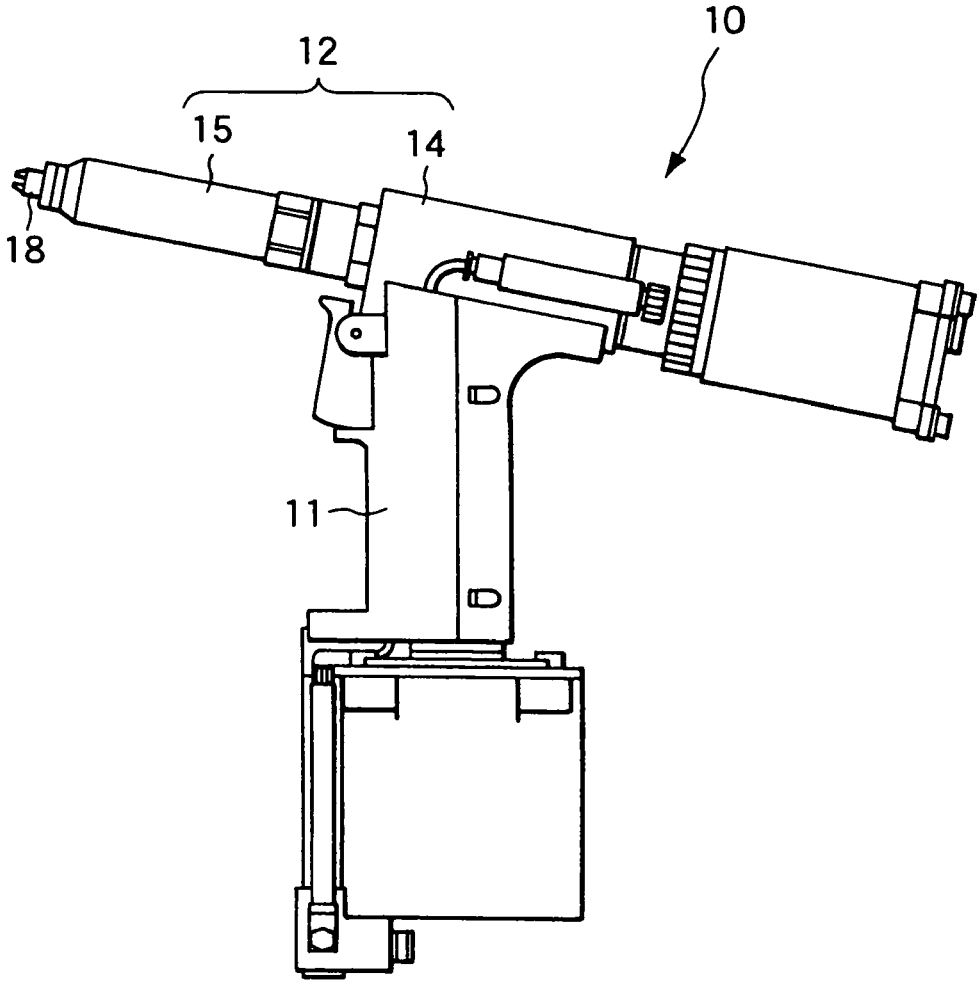
FIG. 2 is a side view of a fastening tool useable in the present invention.

FIG. 2 is a side view of a fastening tool useable in the present invention. The fastening tool 10 includes a housing 12 having a handle 11 for holding with a hand. The housing 12 comprises a main body housing 14 and a nose housing 15. Other components of the fastening tool 10 are known in the art.

Figure 3:
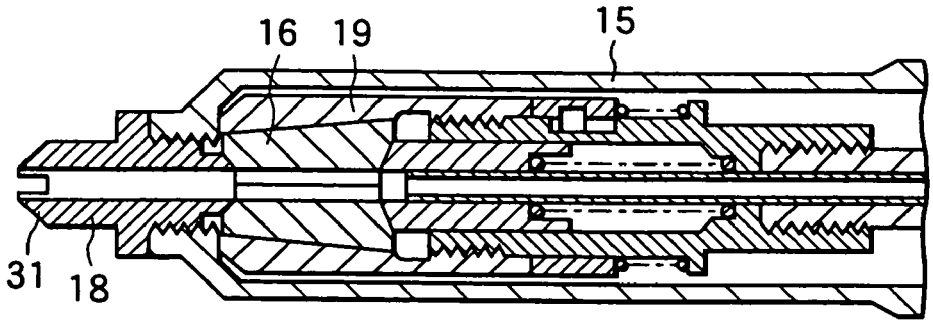
FIG. 3 is a sectional view of a nose housing of the fastening tool.

FIG. 3 is a sectional view of the nose housing 15 of the fastening tool 10. A pair of jaws 16 for holding the front end of the mandrel are mounted inside the nose housing 15, and a cylindrical nosepiece 18 to be brought into contact with the surface of the flange of the rivet is provided on the front end of the jaws. The jaws are surrounded by a jaw case 19 located on the outside thereof. Other components inside the nose housing 15 are known in the art.

Threads are formed at the rear portion of the nosepiece 18, and threads for engaging with the thread of the nosepiece 18 are formed at the front end portion of the nose housing 15, so that the nosepiece 18 is coupled with the nose housing 15 by the engaging these threads. As described above, a protrusion is formed on the nosepiece 18.

Figure 4A:
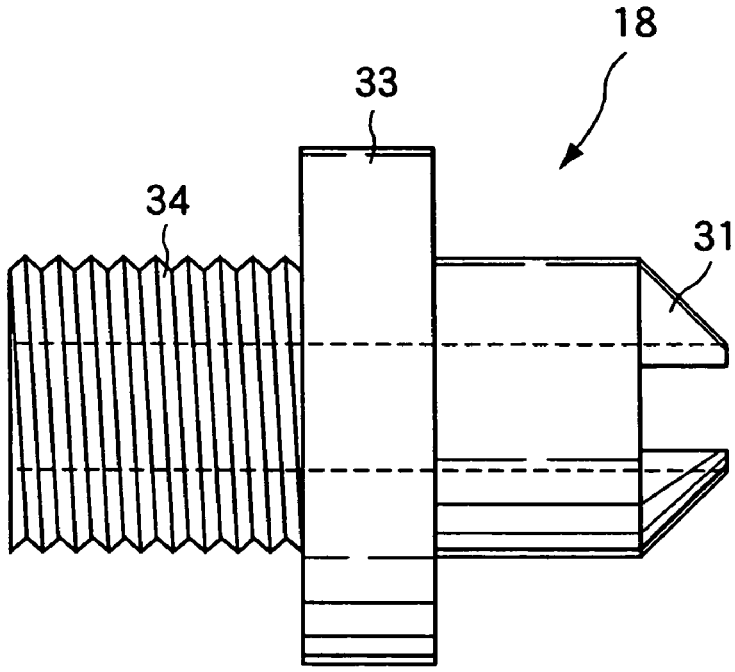
FIG. 4A is an enlarged side view of a nosepiece according to a first embodiment.
Figure 4B:
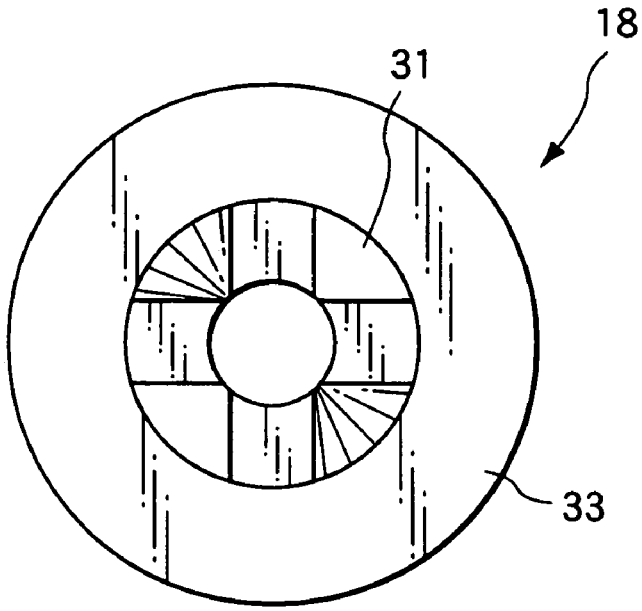
FIG. 4B is an enlarged front view of a nosepiece according to a first embodiment.

FIG. 4A is an enlarged side view of the nosepiece 18 according to a first embodiment of the present invention, and FIG. 4B is an enlarged front view of the nosepiece 18 according to a first embodiment of the present invention. The front end of the nosepiece 18 is provided with a protrusion 31. The protrusion 31 is adapted to bite into the flange of the rivet to form a recess in the flange. The nosepiece 18 has a large diameter portion 33 at the center thereof, and a threaded portion 34 at the rear end thereof. These threads will be engaged with the threads provided in the nose housing 15.

Figure 5A:
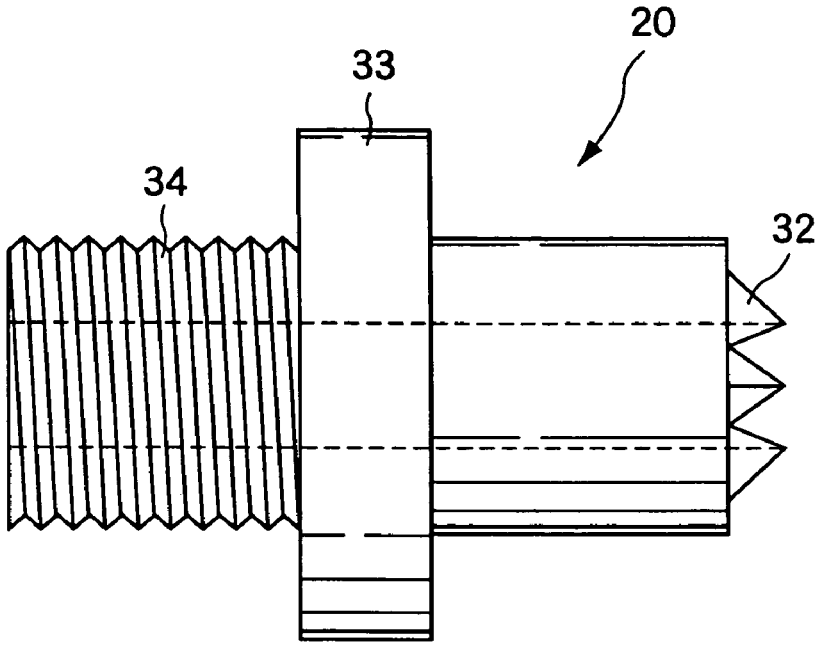
FIG. 5A is an enlarged side view of a nosepiece according to a second embodiment.
Figure 5B:
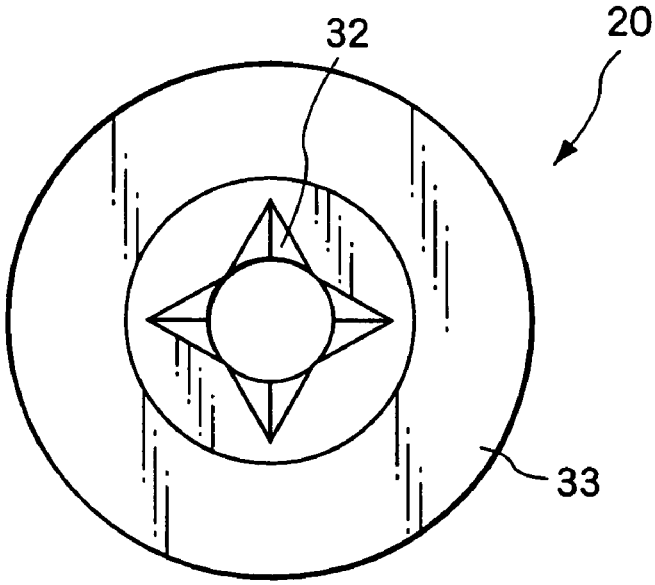
FIG. 5B is an enlarged front view of a nosepiece according to a second embodiment.

FIG. 5A is an enlarged side view of the nosepiece 18 according to a first embodiment of the present invention, and FIG. 5B is an enlarged front view of the nosepiece 18 according to a first embodiment of the present invention. A protrusion 32 is provided on the front end of the nosepiece 20, the protrusion 32 has a different shape from the protrusion 31. Other constitutions are the same as those of the first embodiment.

The present invention will further be described in detail in conjunction with an example and a comparative example.

Figure 6:
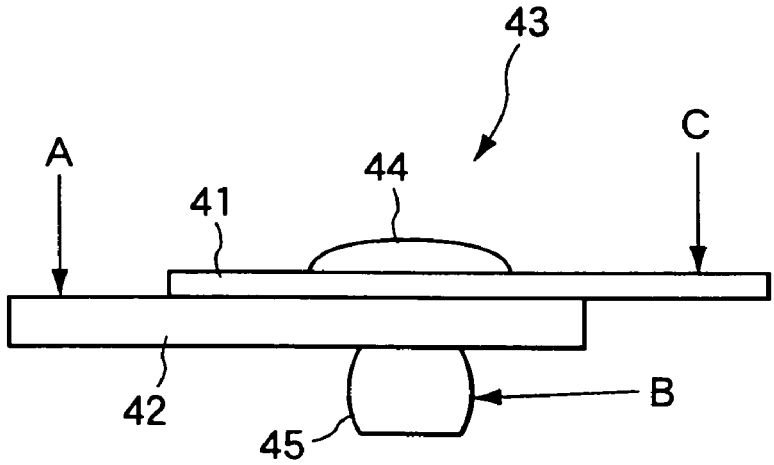
FIG. 6 is an end face view showing the state when the workpieces are fastened with the rivet.

FIG. 6 is an end view showing two workpieces 41 and 42 are fastened together with a rivet 43 by using the nosepiece 18 having the protrusion according to the present invention. Each of the workpieces has a thickness of 1.0 mm, and has a coating by a powder coating process formed on the surface thereof. The rivet 43 includes a flange 44 and a deformed portion 45. Electrical resistance between the workpieces fastened with the rivet by using the nosepiece having the protrusion was measured. A point A on the workpiece 42, a point B on the deformed portion 45 of the rivet 43, and a point C on the workpiece 41 were selected as measurement points of the electrical resistance, and each electrical resistance between the respective measurement points was measured. As a result, each electrical resistance between A–B, B–C, and A–C was approximately zero.

Figure 7:
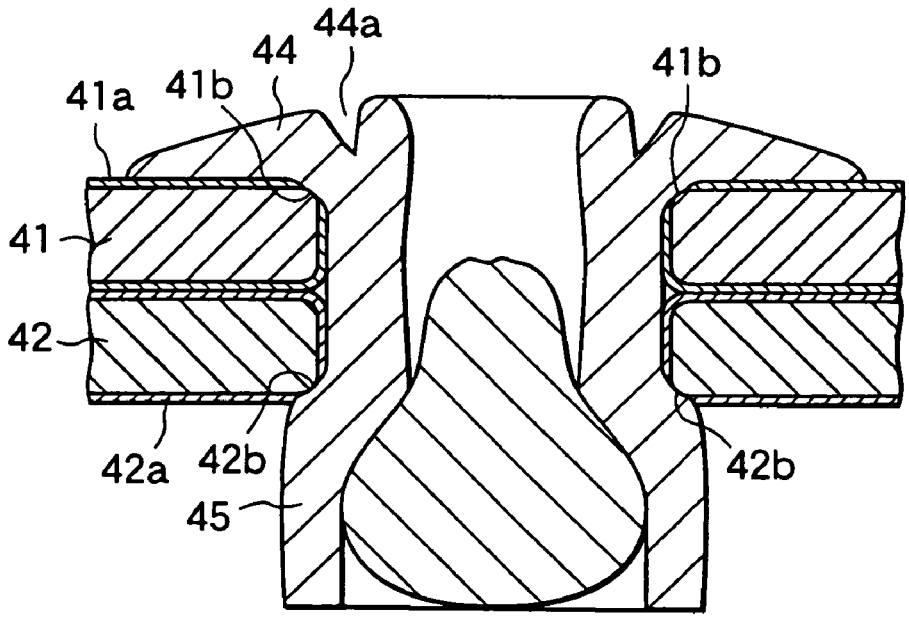
FIG. 7 is a sectional view of the fastened portion of the workpieces.

FIG. 7 is a sectional view of the fastened portion of the workpieces. Coatings 41*a* and 42*a* are formed on the surfaces of the workpieces 41 and 42, respectively. A recess 44*a* is formed in the flange 44 of the rivet at a portion into which the protrusion of the nosepiece bit. The coating is peeled at the corner 41*a* of the workpiece close to the flange 44. The coating is also peeled at the corner 42*b* of the workpiece close to the deformed portion 45 of the rivet.

A comparative example was prepared by fastening the same workpieces 41 and 42 as the above example. The workpieces are fastened with the same rivet 43 and mandrel as the above example. The comparative example was prepared by using a conventional nosepiece having no protrusion. In the same manner as the example, a point A, a point B and a point C were selected as measurement points of electrical resistance, and each resistance between A–B, B–C, and A–C was measured. As a result, while the electrical resistance between A–B was approximately zero, the electrical resistance between B–C and A–C was infinite.

Figure 8:
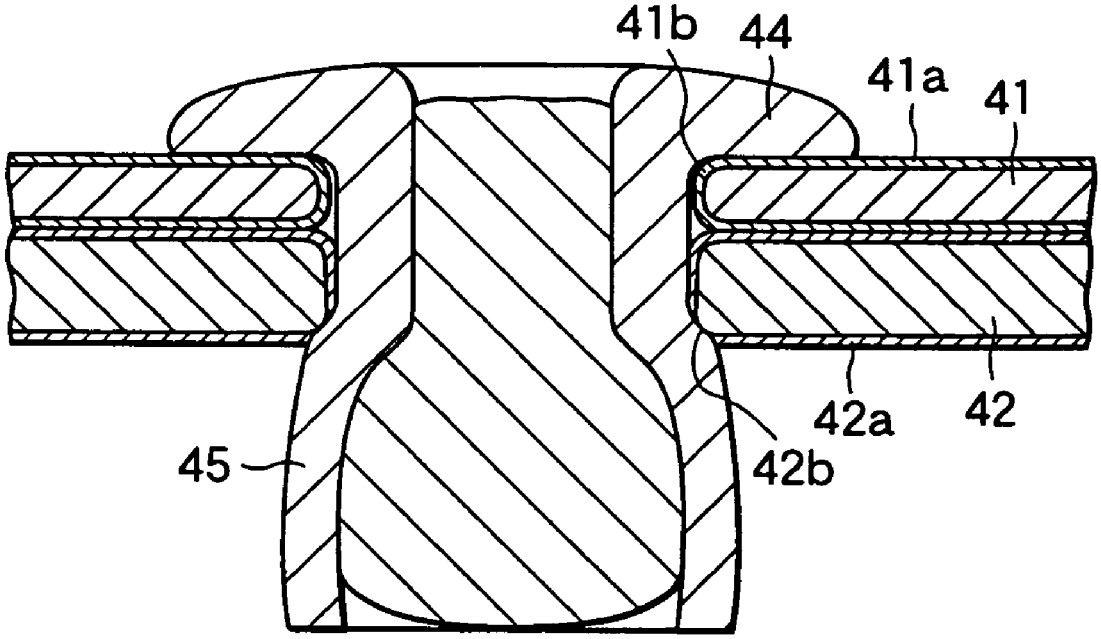
FIG. 8 is a sectional view of a conventional fastened portion of workpieces.

FIG. 8 is a sectional view of the fastened portion of the workpieces in the comparative example. The coating is peeled at the corner 42*b* of the workpiece close to the deformed portion 45 of the rivet, because a strong force is applied to the workpiece due to the deformation of the rivet. Thus, the workpiece 42 and the rivet is electrically conducted to one another. However, a recess is not formed in the flange of the rivet. It can be seen that the coating remains, or is not peeled, at the corner 41*b* of the workpiece closed to the flange 44, and the workpiece 41 and the rivet is not electrically conducted to one another.

As described above, according to the present invention, when the workpieces are fastened with the conventional rivet and the mandrel, the coating of the flange-side workpiece is peeled to assure electrical conductivity between the flange-side workpiece and the rivet.

I claim:

1. A nosepiece to be attached to a fastening tool for fastening workpieces by a rivet and a mandrel, said nosepiece comprising a protrusion for forming a recess in a flange of said rivet, said protrusion defining a plurality of protrusion members each having one of a triangle shape and a diamond shape, each member substantially equidistantly spaced from a proximate one of the members.

2. A fastened structure comprising a rivet, a mandrel, and workpieces fastened together with said rivet and said mandrel, wherein said rivet includes a flange having a recess formed by a nosepiece attached to a fastening tool and provided with a protrusion, and a stem deformed to increase in its diameter by a caulking portion of said mandrel, the recess is formed in the flange and the stem is deformed when a shank of said mandrel is drawn by said fastening tool, and a coating of one of said workpieces on a workpiece side contacting said flange being partially peeled due to contact with said flange proximate said recess, whereby said one workpiece and said rivet define an electrically conductive junction relative to one another.

3. A method for fastening workpieces together with a rivet, comprising the steps of:

disposing a mandrel having a caulking portion and a shank with a hollow rivet having a flange and a stem, and positioning said combined mandrel and rivet in a hole formed in said workpieces;

bringing a nosepiece fixed to a fastening tool and provided with a protrusion into contact with said flange of said rivet;

drawing said shank of said mandrel by said fastening tool to deform said stem of said rivet to increase in its diameter;

breaking said mandrel at a breaking portion thereof during said drawing of said mandrel shank; and making said protrusion of said nosepiece fixed to said fastening tool bite into said flange of said rivet to form a recess in said flange of said rivet and thereby partially peel a coating of one of said workpieces on the side of said flange, whereby electrical conductivity between said flange-side workpiece and said rivet is established.

4. A fastening tool for fastening workpieces together with a rivet and a mandrel, said fastening tool comprising:

an elongated hollow housing;

a jaw provided inside said housing movable with respect to said housing and adapted to engage with and hold a shank of said mandrel;

a nosepiece adapted to be attached to a front end of said housing and to engage with a flange of said rivet, said nosepiece having a protrusion; and said protrusion including a plurality of protrusion members each having one of a triangle shape and a diamond shape, said members operable to create a plurality of recesses in the flange, each member substantially equidistantly spaced from a proximate one of the members;

wherein said protrusion of said nosepiece is adapted to bite into said flange of said rivet to form said recesses in said flange and thereby partially peel a coating of said workpieces, resulting in electrical conductivity between said workpieces and said rivet being established.

* * * * *